United States Patent [19]

Itaya et al.

[11] Patent Number: 4,491,083

[45] Date of Patent: Jan. 1, 1985

[54] MEANS FOR DEVELOPING AN ELECTROSTATIC LATENT IMAGE

[75] Inventors: Masahiko Itaya; Satoshi Haneda; Makoto Tomono, all of Hachioji, Japan

[73] Assignee: Konishiroku Photo Industry Co., Ltd., Tokyo, Japan

[21] Appl. No.: 400,927

[22] Filed: Jul. 22, 1982

[30] Foreign Application Priority Data

Aug. 1, 1981 [JP] Japan ..... 56-12087

[51] Int. Cl.[3] ..... G03G 15/09

[52] U.S. Cl. ..... 118/657; 118/653

[58] Field of Search ..... 118/657, 653

*Primary Examiner*—Bernard D. Pianalto

*Attorney, Agent, or Firm*—Bierman, Bierman & Peorff

[57] ABSTRACT

A developing apparatus for developing an electrostatic latent image on a charge receptor comprising a developing member for supplying toner to the electrostatic latent image on the charge receptor and an image forming means arranged in developing direction downstream of said developing member, said image forming means including an electrode to which a voltage is applied so as to form an alternating electric field between said charge receptor and said electrode, and means for applying said voltage to said electrode.

13 Claims, 3 Drawing Figures

MEANS FOR DEVELOPING AN ELECTROSTATIC LATENT IMAGE

BACKGROUND OF THE INVENTION

1. Field of the Invention

The present invention relates in general to a means for developing an electrostatic latent image and in particular to the means for developing the electrostatic latent image that enables to obtain a visible image with a high image density, an excellent sharpness and less fog.

2. Description of the Prior Art

In the past, there have been a powder cloud method to develop with a toner in the state of a powder cloud, an impression method wherein a uniform toner layer formed on a toner holder is contacted to a charge receptor or a microfield method, a magnetic brush developing method wherein a magnetic toner is used, and other developing methods for the electrostatic latent image wherein insulating one-component developer is used, in particular.

The drawbacks common to aforesaid developing methods of have been that the force to attract the toner to the toner holder is weak and therefore toner adheres also to the non-image area due to the physical adhering force, which tends to cause a fog. Further, these methods have been insufficient in image-sharpness and they have been problematic in practical use.

On the other hand, a jumping method has been used wherein the toner and the latent image are kept in the non-contact state and an alternating electric field is impressed for developing the image. This method has a technical difficulty because it is necessary to keep the thickness of a toner layer on the toner holder extremely thin.

Generally, the following factors are considered to be the cause of image quality deterioration in the developing method using one-component developer.

(1) Physical adherence of the toner to the non-image area (2) Tailing phenomenon caused by the excessive development at the edge portion of a toner image (3) Adherence of the toner with inverted polarity to the fringe portion of a toner image (fringe phenomenon)

In the developing method wherein a one-component developer is used, it is difficult to cause a sufficient electric field to be generated between a toner holder and an image holder as shown in FIG. 1(*a*) because no carrier is used and therefore an edge effect tends to be caused. In the figure, I represents an electrostatic latent image area, D represents a carrier and T represents a toner. (FIG. 1(*b*) shows a state of an electric field where a two-component developer is used.) Therefore, when a large area is to be developed with a high density, excessive toner adheres to the edge portion and the disturbance of the obtained image is caused when developing or transferring. This results in vignette characters and halftone dots.

On the other hand, fog is caused by adherence of toner due to a residual voltage of the photosensitive receptor as an image holder, or by Van der Waals force or a mirror-effect force. In the case of one-component toner, it is difficult to obtain a bias effect that can oppose these physical forces and consequently it is impossible to control the fog.

Further, in the case of a one-component toner, there inevitably exists toner charged with an inverted polarity and the adherence of toner to the fringe portion of an image (a fringe phenomenon) takes place, which leads to the phenomenon wherein resolution quality is lowered.

SUMMARY OF THE INVENTION

The object of the present invention is to resolve the drawbacks in the developed image wherein aforesaid single-component toner is used. The object is attained by the developing apparatus for an electrostatic latent image comprising a developing means to develop the electrostatic latent image on the image holder, and an image forming means composed of an electrode, that is arranged opposite to the holder for the developed image, and a voltage-impressing means to impress a voltage on said electrode. In the present invention, the image forming means is arranged such that unnecessary toner, that causes deterioration of image quality, is removed by impressing the voltage on the developed image, thus the image quality with no fog and high sharpness can be obtained.

A detailed description of the present invention is provided as follows, with reference to the drawings.

DETAILED DESCRIPTION OF THE PREFERRED EMBODIMENTS

Figure 1A:
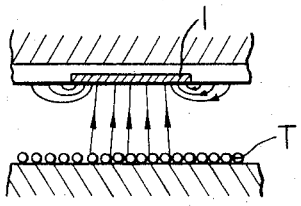
FIGS. 1*a* and 1*b* show the state of an electric field of an electrostatic latent image portion on a charge receptor for one-component and two-component developer, respectively.
Figure 1B:
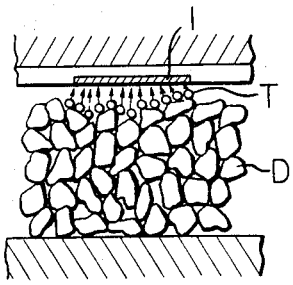
Figure 2:
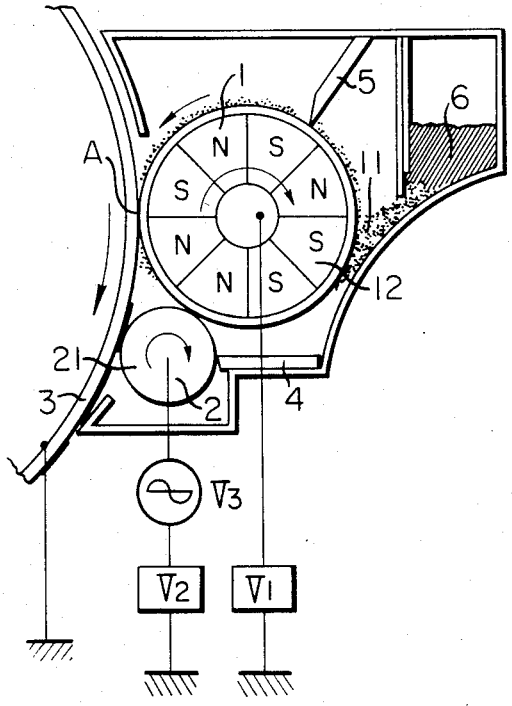
FIG. 2 illustrates an example of the developing apparatus of the present invention.

FIG. 2 illustrates an example of the present invention. A developer is made of an insulating one component magnetic toner wherein magnetites are dispersed in the resin. The developing apparatus comprises two parts. One is a developing device 1 to develop an electrostatic latent image and the other is an image forming device 2 to remove the unnecessary toner.

The developing method may be any one of a powder cloud method, a touchdown method, an impression method or a magnetic brush method. In the illustrated example, there is employed a magnetic brush developing device comprising a conductive non-magnetic developing sleeve 11 and a magnet roll 12.

The image forming means 2 comprises a roller 21 made of non-magnetic metal as an electrode. The numeral 3 denotes a charge receptor in the shape of a cylindrical drum. The rotating directions of the developing sleeve 11, the roller 21 and the charge receptor 3 are shown by the arrows in FIG. 2. In rotational speed, the linear speed of the charge receptor 3 is the slowest.

The dimension of clearance between the developing sleeve 11 and the charge receptor 3 is 0.3 mm, the dimension of clearance between the roller 21 and the charge receptor 3 is 0.2 mm and the clearance between the developing sleeve 11 and the charge receptor 3 is 0.2 mm. Incidentally, the thickness of a developer layer on the surface of the developing sleeve is 0.1 mm, and the aforesaid items are thus arranged closely with clearances which are larger than the thickness of the developer layer.

The voltage of the electrostatic latent image on the charge receptor 3 is +700V maximum and the residual voltage on the charge receptor is about +100V. Consequently, the bias voltage (V1) of +150V is impressed on the developing device 1 so that fogging is reduced when developing.

On the roller 21, the superposed voltage of DC 100V (V2) and AC 300V (V3) is impressed in order to remove the fog of the developed toner image and excessive toners on the charge receptor. In order to remove said toners with inverted polarity, it is necessary to use DC −100V (V2). In order to remove excessive toners charged at both poles, two rollers of (+) and (−) polarity may be necessary for DC (V2). This example provides only one roller 21 on which the superposed voltage of DC +100V (V2) and AC 300V (V3) is impressed because the disturbance of the developed toner image caused by the toner with an inverted polarity is insignificant.

When V1 and V2 are the same in polarity, and |V1| is larger than |V2|, excessive toners adhering to the roller 21 are collected on the developing sleeve 11.

Next, the functions of the developing apparatus of the present invention will be explained. Insulating one-component magnetic toner in the developer supplying hopper 6 is supplied to the surface of the developing sleeve 11. The toner adheres magnetically to said sleeve and is transported thereon. The tichkness of the developer layer adhering to the developing sleeve 11 is regulated evenly by a developer layer thickness regulating member 5, and the developer arrives at the developing area A.

The electrostatic latent images formed on the charge receptor 3, on the other hand, are developed by the developing device 1 at the developing area A. After being developed, the charge receptor 3 rotates downward opposite roller 21 and the fog-causing toners of the developed toner images and excessive toners on the charge receptor are removed by said roller 21 from the surface of the said charge receptor 3. Removed toners are adhered and collected on the roller 21 and then are returned to the developing device 1. Collected toners that remain on the roller 21 without being returned to the developing device 1 are scraped off by a cleaning blade 4 as a cleaning member.

Passing through the aforesaid steps, it is possible to obtain good images with a high sharpness and without any fog.

In the present example, it is possible to prevent a spark discharge if a thin insulating film is formed on the surface of the roller 21. It is further helpful to put a resistance in series in the power source section.

Regarding V1 and V2, it is further effective for fog-elimination to make the voltage of the power source V2 high independently of the relation of $|V1| > |V2|$. For this, however, toner would not be transferred electrostatically from the roller 21 to the developing device 1 and consequently the load for the cleaning member 4 is increased.

With many inverted polarized toners, the fringe phenomenon occurs by said inverted polarized toners adhering to the charge receptor which should be removed. In this case, it is possible to remove the inverted polarized toner by impressing D.C. voltage with a polarity opposite to the toner that generates fringing, namely opposite to the charge receptor such as a photosensitive receptor superposed with alternating current to the electrode in the image forming means of the present invention.

As explained above, the present invention enables to remove unnecessary toners adhering to the charge receptor and thereby the improvement in high image quality, such image sharpness, the resolution and gradient is possible. Further, concerning the environment-dependence that is problematic for one-component developer, the possibility for image improvement is broadened.

Incidentally, according to the specification of Japanese Patent Publication Open to Public Inspection No. 105267/1980, there is proposed a jumping method wherein non-contact development is made by the developer with an improvement in image quality. However, the experiments made by the inventors of the present invention prove that sufficient density and resolution can be obtained by the contact-development of the invention, instead of using a non-contact method. Further, no impression of bias voltage is necessary for the contact-development by the developing device. Problems for this method are the adherence of excessive toners to the edges of images especially to the trailing edges of images, which is opposite to the aforesaid proposal. Further, in the case of the contact-development, the fog tends to be generated by inaccuracy in the mounting of a developing apparatus or by a change in the developing environment. The concept and object of the present invention are different from those of the aforesaid proposal and, with the present invention, unnecessary toners adhering to the photosensitive receptor are removed and the improvement of high image quality is realized.

What is claimed is:

1. A developing apparatus for developing an electrostatic latent image on a charge receptor comprising a developing member for supplying toner to the electrostatic latent image on the charge receptor and an image forming means arranged in a developing direction downstream of said developing member, said image forming means including an electrode to which a voltage is applied so as to form an alternating electric field between said charge receptor and said electrode, and means for applying said voltage to said electrode.

2. The developing apparatus acording to claim 1, wherein said voltage consists of an alternating current voltage.

3. The developing apparatus according to claim 1, wherein said voltage consists of an alternating current voltage superposed with a direct current voltage.

4. The developing apparatus according to claim 2, wherein said alternating current voltage is commercial alternating current voltage.

5. The developing apparatus according to claim 2, wherein said alternating current voltage is a pulse voltage.

6. A developing means according to claim 3, wherein said direct current voltage has an opposite polarity to the polarity of the electrostatic latent image on said charge receptor.

7. The developing apparatus according to claim 1, wherein said electrode is a non-magnetic column or cylinder which is rotatable.

8. The developing apparatus according to claim 1, wherein said electrode has a thin insulating film formed on its surface for preventing electrostatic discharges.

9. The developing apparatus according to claim 1, wherein said developing member comprises a non-magnetic cylindrical sleeve and a permanent magnet disposed in said sleeve.

10. The developing apparatus according to claim 9, wherein a first clearance between said charge receptor and said developing sleeve, and a second clearance between said electrode and said charge receptor are larger than the thickness of a developer layer formed on the surface of said developing member.

11. The developing apparatus according to claim 9, wherein a first direct current voltage (V1) is impressed on said sleeve, a second direct current voltage (V2) and an alternating electric field are superposed and impressed on said electrode, and a third voltage (Vs) is present in a non-image area on said charge receptor, the relations of these voltages being represented by the following:

$$|Vs| \leqq |V2| \leqq |V1|.$$

12. The developing apparatus according to claim 11, wherein the polarity of the first direct current voltage is the same polarity as that of the electrostatic latent image on the surface of said charge receptor.

13. The developing apparatus according to claim 1, wherein said toner is a one-component type developer.

* * * * *